US012709875B2

(12) United States Patent
Ruvang

(10) Patent No.: US 12,709,875 B2
(45) Date of Patent: Aug. 18, 2026

(54) WEAR COMPONENT ASSEMBLY WITH ADAPTER WEAR CAP

(71) Applicant: BLACK CAT WEAR PARTS, LTD., Edmonton (CA)

(72) Inventor: John A. Ruvang, Bartonville, TX (US)

(73) Assignee: BLACK CAT WEAR PARTS, LTD., Edmonton (CA)

( * ) Notice: Subject to any disclaimer, the term of this patent is extended or adjusted under 35 U.S.C. 154(b) by 374 days.

(21) Appl. No.: 18/468,550

(22) Filed: Sep. 15, 2023

(65) Prior Publication Data

US 2025/0092646 A1 Mar. 20, 2025

(51) Int. Cl.
*E02F 9/28* (2006.01)

(52) U.S. Cl.
CPC ..... *E02F 9/2883* (2013.01); *E02F 9/2825* (2013.01)

(58) Field of Classification Search
CPC ..... E02F 9/2883; E02F 9/2825
USPC ..... 37/453
See application file for complete search history.

(56) References Cited

U.S. PATENT DOCUMENTS 4,428,131 A * 1/1984 Hahn ..... E02F 9/2841 37/453
4,587,751 A 5/1986 Sjogren et al.
4,716,667 A * 1/1988 Martin ..... E02F 9/2816 37/456
5,172,501 A 12/1992 Pippins
5,666,748 A * 9/1997 Emrich ..... E02F 9/2883 403/374.1
11,447,937 B2 9/2022 Hernandez et al.
2022/0243428 A1 8/2022 Hankland et al.
2022/0325505 A1 10/2022 Johnston et al.

OTHER PUBLICATIONS

International Search Report with Written Opinion issued Feb. 13, 2025 for PCT Patent Application No. PCT/IB2024/058606, 10 pages.
BYG SAU, BYG one source for your mining needs, product brochure, downloaded Jul. 31, 2023.

* cited by examiner

*Primary Examiner* — Muhammad Shafi
(74) *Attorney, Agent, or Firm* — Smith IP Services, P.C.

(57) ABSTRACT

A wear component assembly can include an adapter having rearwardly extending bifurcated legs and a wear cap secured external to a leg with a fastener, the fastener extending laterally through the leg. Another wear component assembly can include a wear cap secured external to an adapter leg with a fastener, in which contact between the fastener and a recess formed in the wear cap limits rearward movement of the wear cap relative to the adapter. A wear cap can include a body configured to overlie at least a portion of an adapter leg, a tab at a rear end of the body, the rear tab having a recess formed therein and extending laterally across the tab and facing rearward, and another tab at a forward end of the body, the forward tab having another recess configured to receive a portion of the adapter therein.

18 Claims, 7 Drawing Sheets

WEAR COMPONENT ASSEMBLY WITH ADAPTER WEAR CAP

BACKGROUND

This disclosure relates generally to earth-moving, mining and other types of material-handling equipment and, in an example described below, more particularly provides an adapter wear cap for a wear component assembly.

Material handling implements (such as buckets, shovels and other types of excavation and mining implements) are frequently provided with replaceable wear components. For example, wear components can be used to protect a forward material-engaging lip of a material handling implement, in order to prevent or delay repair or replacement of the lip, and to achieve other purposes (such as, to enhance the effectiveness of the implement in engaging or breaking up the material).

The wear components are subjected to a variety of different loads from various directions during material handling operations. Replacement of wear components can be costly and time-consuming.

It will, therefore, be appreciated that improvements are continually needed in the art of designing, constructing and using wear components for material handling implements. Such improvements are provided to the art by the present disclosure, and these improvements can be realized in a wide variety of different configurations.

DETAILED DESCRIPTION

Figure 1:
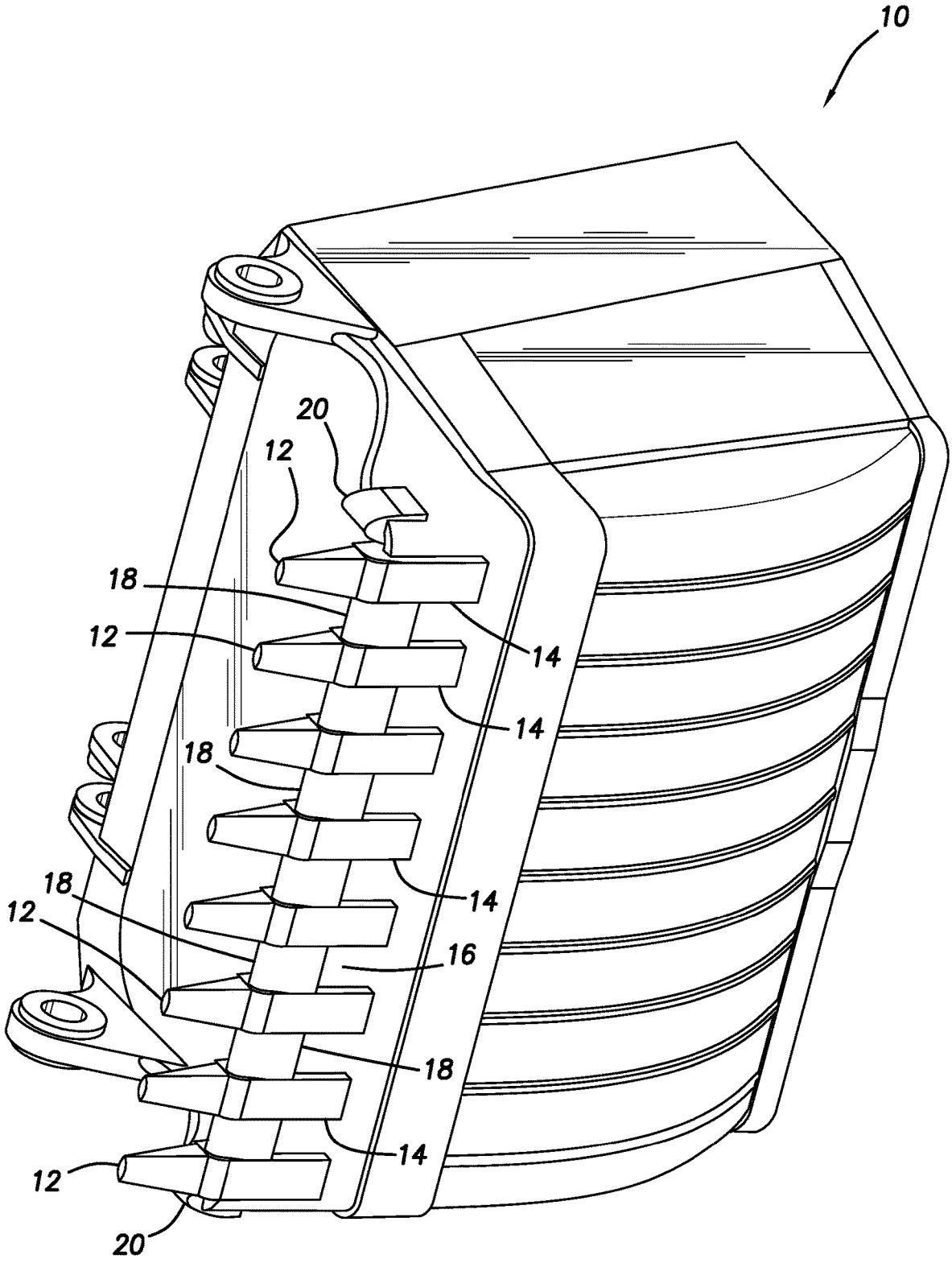
FIG. 1 is a representative partially cross-sectional view of an example of a material handling implement which can embody principles of this disclosure.

Representatively illustrated in FIG. 1 is an implement 10 for a material handling apparatus which can embody principles of this disclosure. However, it should be clearly understood that the implement 10 is merely one example of an application of the principles of this disclosure in practice, and a wide variety of other examples are possible. Therefore, the scope of this disclosure is not limited at all to the details of the implement 10 described herein and/or depicted in the drawings.

In the example of FIG. 1, the implement 10 is of the type known as a "dipper" or "bucket" of a cable shovel, but it should be clearly understood that the principles of this disclosure can be utilized with other types of mining, excavation (or other material handling) implements. In the illustration of FIG. 1, the implement 10 is rotated so that a bottom material-engaging side of the implement is clearly visible. From this perspective, it may be seen that multiple teeth 12 are mounted on the implement 10 for piercing the earth or other material.

The teeth 12 are typically rapidly worn down or otherwise damaged during use of the implement 10, and so the teeth are replaced periodically or when excessive wear is evident. Specially configured adapters 14 releasably secure the teeth 12 to a forward edge of a lip 16 of the implement 10 in this example. In other examples, the teeth 12 may be secured directly to the lip 16.

The teeth 12 and adapter 14 are merely examples of wear components that can be securely and conveniently attached to a material handling implement using the principles of this disclosure. Other examples of wear components include shrouds 18, 20 which protect forward material-engaging edges of the lip 16 and sides of the implement 10. Thus, the scope of this disclosure is not limited to use of any particular types of wear components.

As used herein, the term "forward" is used to indicate a direction in which the implement 10 displaces to engage a material. Thus, a forward edge of the lip 16 would first engage the material, if the forward edge were not protected by the teeth 12, adapter 14 and shrouds 18, 20. The term "rearward" is used to indicate an opposite direction. Thus, in the FIG. 1 example, a rearward direction would be toward a back of the implement 10 from the forward edge of the lip 16.

Referring additionally now to FIGS. 2-7, an example of a wear component assembly 30 that may be used with the FIG. 1 implement 10 is representatively illustrated. However, the wear component assembly 30 may be used with other material handling implements in keeping with the principles of this disclosure, which are not limited to the specific details of the wear component assembly example as described herein or depicted in the drawings.

Figure 2:
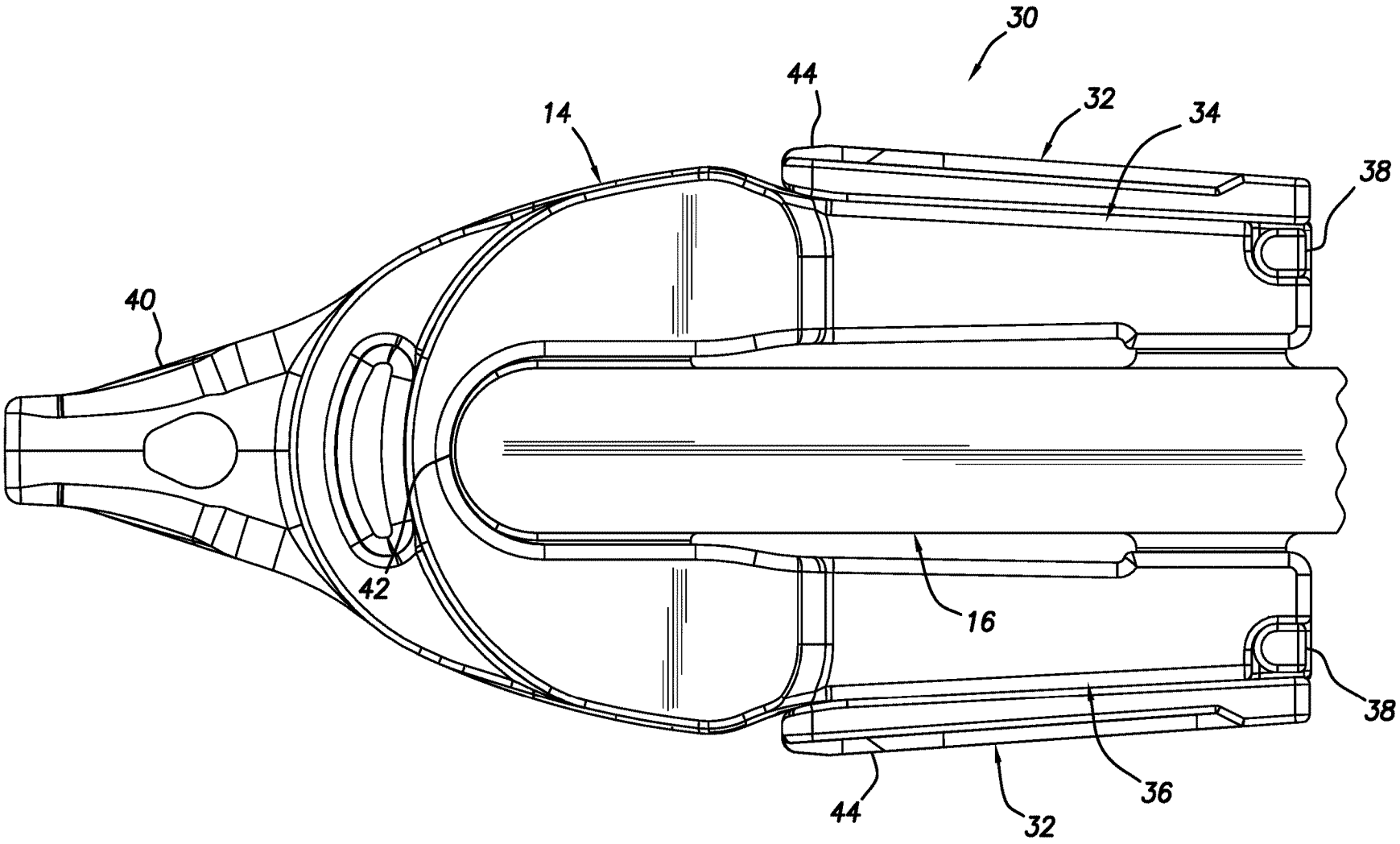
FIG. 2 is a representative partially cross-sectional view of an example of a wear component assembly positioned on a lip of the material handling implement of FIG. 1.

Referring specifically now to FIG. 2, a partially cross-sectional view of one example of the wear component assembly 30 is representatively illustrated. The wear component assembly 30 is depicted as being positioned on the lip 16 of the material handling implement 10 of FIG. 1.

In the FIG. 2 example, the wear component assembly 30 includes an adapter 14 and wear caps 32 covering rear portions of respective legs 34, 36 of the adapter 14. The wear caps 32 are releasably secured to the respective legs 34, 36 with fasteners 38 that extend laterally through the respective legs.

The adapter 14 includes a forwardly extending nose 40. The nose 40 is suitably configured for mounting a tooth (such as, the FIG. 1 tooth 12) to the adapter 14.

The legs 34, 36 extend rearward from the nose 40. The legs 34, 36 are suitably configured to wrap around a forward end 42 of the lip 16 and provide for fastening the adapter 14 to the lip. A conventional fastener assembly known to those skilled in the art as a "Whisler" type may be used to releasably secure the adapter 14 to the lip 16, although other types of fastener assemblies may be used in other examples.

The wear caps 32 in this example serve to protect the rear portions of the adapter legs 34, 36 from wear and damage in operation of the implement 10. Each wear cap 32 includes a sacrificial body 44 that overlies a rear portion of the respective adapter leg 34, 36. In some examples, a hardness or abrasion resistance of the wear caps 32 may be greater than a hardness or abrasion resistance of the adapter legs 34, 36.

Figure 3:
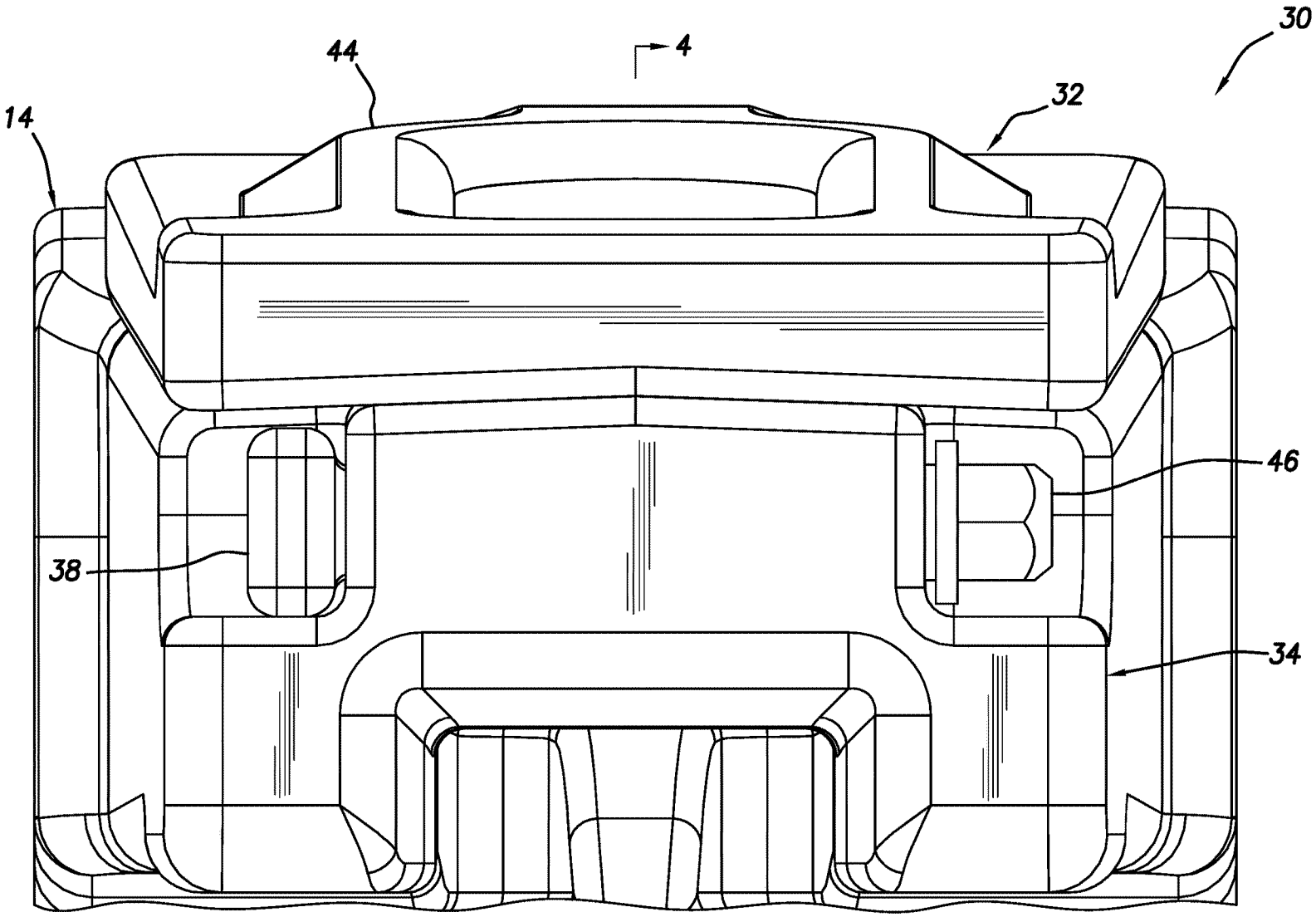
FIG. 3 is a representative rear elevational view of an upper leg of an adapter of the wear component assembly.

Referring additionally now to FIG. 3, a rear elevational view of the upper leg 34 of the adapter 14 is representatively illustrated. The upper leg 34 is substantially a mirror image of the lower leg 36, so it should be understood that the following description of the upper leg and its wear cap 32 is also relevant to the lower leg and its wear cap. However, it is not necessary for both of the legs 34, 36 to have a wear cap 32. The wear cap 32 is, thus, optional on either of the legs 34, 36.

In the FIG. 3 example, the fastener 38 passes laterally through a rear end of the leg 34. A nut 46 is threaded on an end of the fastener 38 to secure the fastener in the leg 34. As described more fully below, the fastener 38 is received in a lateral recess formed in the wear cap 32, in order to secure a rear end of the wear cap 32 to the leg 34.

Figure 4:
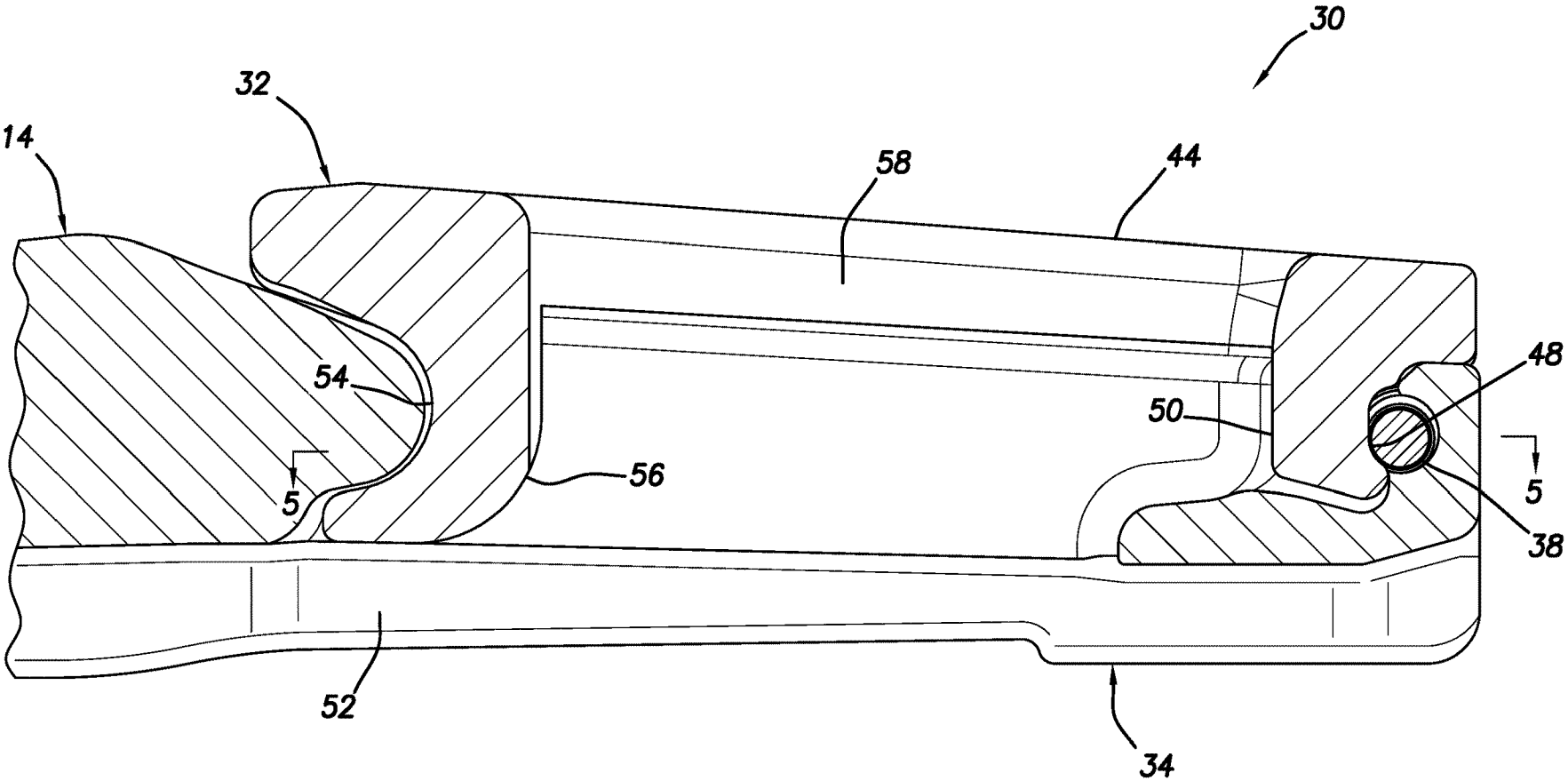
FIG. 4 is a representative cross-sectional view of the upper adapter leg and an example of a wear cap of the wear component assembly, taken along line 4-4 of FIG. 3.

Referring additionally now to FIG. 4, a cross-sectional view of the upper adapter leg 34 and the wear cap is representatively illustrated. The FIG. 4 cross-sectional view is taken along line 4-4 of FIG. 3.

In FIG. 4, the manner in which the fastener 38 secures the rear end of the wear cap 32 can be seen. The fastener 38 is received in a rearward facing and laterally extending recess 48 formed in a J-shaped tab 50 extending downwardly from the body 44 of the wear cap 32. In other examples, multiple tabs 50 may be provided at the rear end of the wear cap 32.

A forward end of the wear cap 32 is also secured to the adapter leg 34. A portion of the adapter 14 at a forward end of a fastener opening 52 formed through the leg 34 is received in a forward facing recess 54 formed in a J-shaped tab 56 extending downwardly from the body 44 of the wear cap 32. In other examples, multiple tabs 56 may be provided at the forward end of the wear cap 32.

In the FIG. 4 example, an opening 58 is formed through the body 44 of the wear cap 32. The opening 58 is aligned with the fastener opening 52 in the leg 34. The aligned openings 52, 58 permit a fastener assembly (such as, a Whisler type fastener assembly) to be installed in the adapter 14 either prior to, or after, the wear cap 32 is secured to the leg 34.

Figure 5:
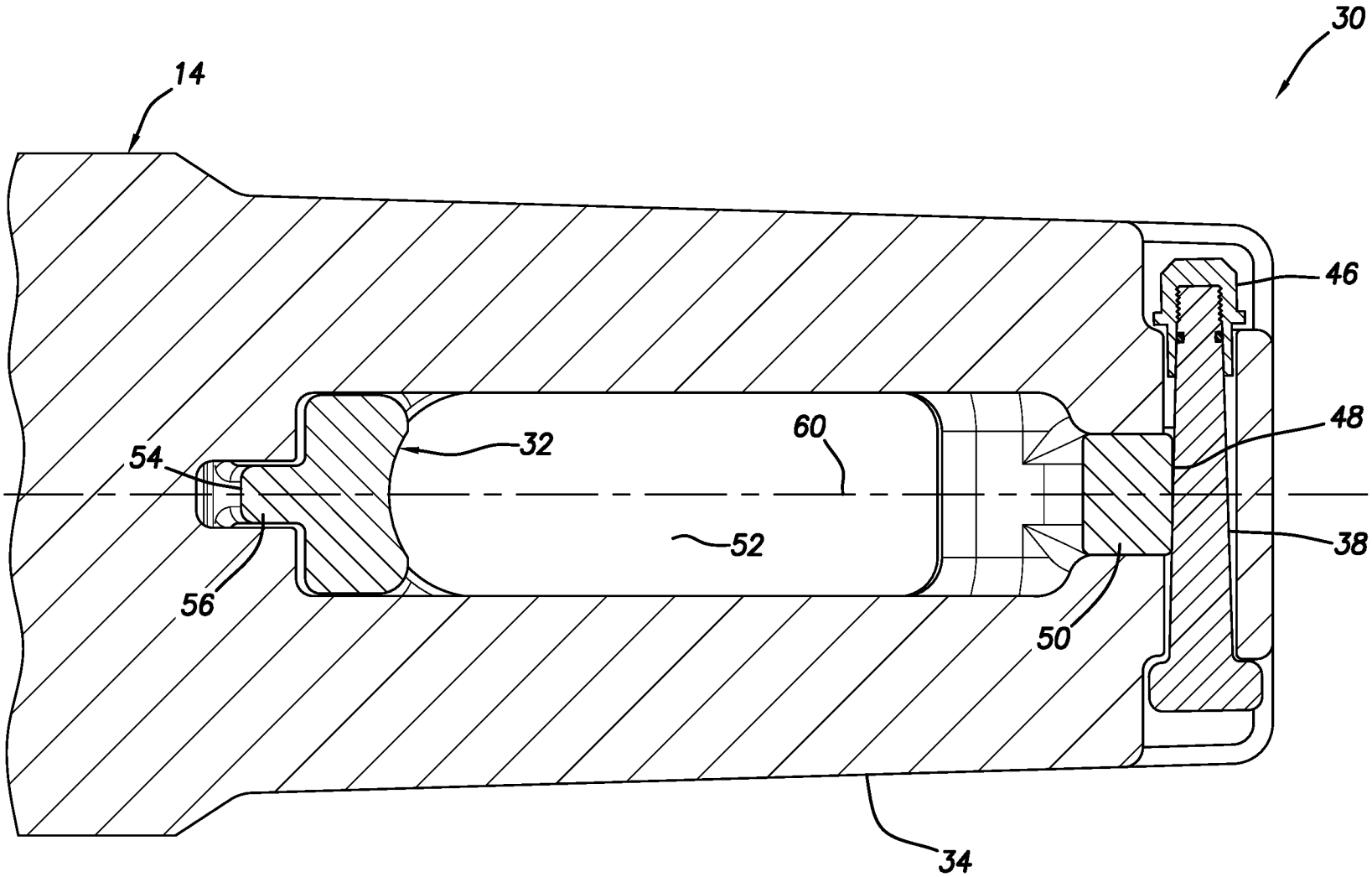
FIG. 5 is a representative cross-sectional view of the upper adapter leg and the wear cap, taken along line 5-5 of FIG. 4.

Referring additionally now to FIG. 5, a cross-sectional view of the upper adapter leg 34 and the wear cap 32 is representatively illustrated. The FIG. 5 cross-sectional view is taken along line 5-5 of FIG. 4.

In FIG. 5, the manner in which the fastener 38 extends laterally through the rear end of the leg 34 can be seen. The fastener 38 is oriented perpendicular or orthogonal to a longitudinal axis 60 of the adapter 14. The engagement between the fastener 38 and the recess 48 in the tab 50 prevents or at least limits rearward movement of the wear cap 32 relative to the leg 34 as described more fully below.

Figure 6:
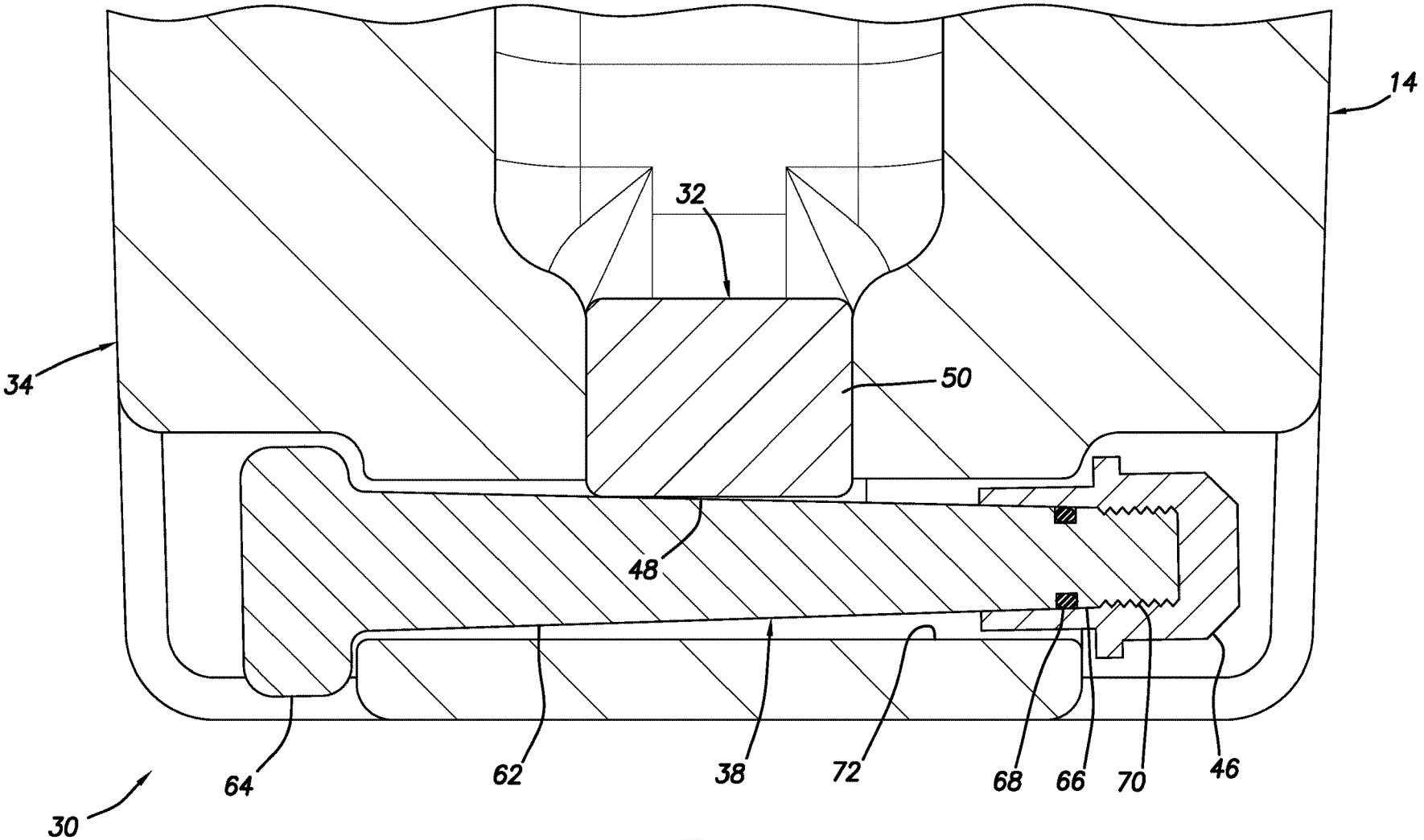
FIG. 6 is a representative cross-sectional view of an example of a fastener of the wear component assembly and a rear end of the upper adapter leg.

Referring additionally now to FIG. 6, a cross-sectional view of an example of the fastener 38 and the rear end of the upper adapter leg 34 is representatively illustrated. FIG. 6 is depicted at an enlarged scale and rotated ninety degrees relative to the FIG. 5 view.

In FIG. 6, it may be seen that a shank 62 of the fastener 38 is tapered along its length. The fastener 38 is tapered along a majority of its length. In the FIG. 6 example, the fastener 38 is tapered and gradually decreases in diameter from a head 64 of the fastener to a threaded and sealed end 66 received in the nut 46.

The tapering of the fastener 38 facilitates removal of the fastener from the rear end of the adapter leg 34 after the implement 10 has been used. However, the tapering may not be used in other examples.

In the FIG. 6 example, a seal 68 is carried on the fastener end 66 for sealing engagement in the nut 46. The seal 68 prevents debris from becoming lodged in threads 70. In other examples, the seal 68 may not be used, or the seal may be carried inside the nut 46.

The fastener 38 extends through an opening 72 formed laterally through the rear end of the leg 34. In the FIG. 6 example, the opening 72 is not tapered, but in other examples the opening 72 could be tapered, for example, to match the taper on the fastener 38.

The fastener 38 engages the recess 48 in the tab 50 to limit rearward movement of the wear cap 32 and to secure the rear end of the wear cap to the leg 34. In the FIG. 6 example, the recess 48 is not tapered, but in other examples the recess could be tapered, for example, to match the taper on the fastener 38.

Figure 7:
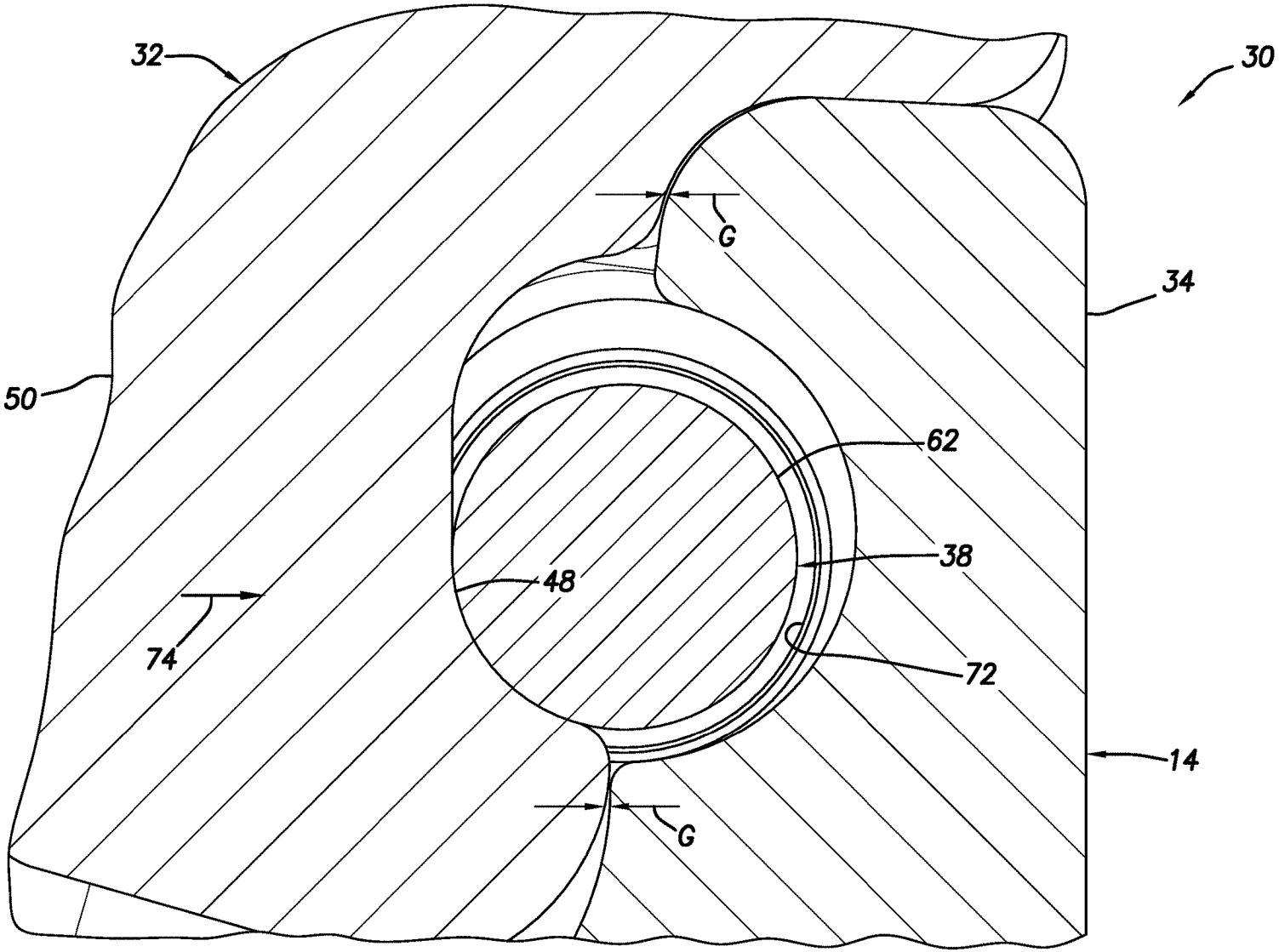
FIG. 7 is a representative cross-sectional view of the fastener installed between the wear cap and the rear end of the adapter upper leg.

Referring additionally now to FIG. 7, a cross-sectional view of the fastener 38 installed between the wear cap 32 and the rear end of the adapter upper leg 34 is representatively illustrated. The FIG. 7 view is enlarged in scale relative to the cross-sectional view of FIG. 4. In FIG. 7, the manner in which the fastener 38 limits rearward movement 74 of the wear cap 32 relative to the adapter 14 can be seen.

In the FIG. 7 example, the wear cap 32 has been displaced rearward (for example, as a result of loads experienced in operation of the implement 10), until the tab 50 contacts the shank 62 of the fastener 38. Further rearward movement of the wear cap 32 on the adapter leg 34 is, thus, prevented.

Note that, with the recess 48 contacting the fastener 38 as depicted in FIG. 7, longitudinal gaps G remain between the rear end of the wear cap 32 and the rear end of the adapter leg 34. Thus, rearward movement 74 of the wear cap 32 is not limited by any contact with the rear end of the adapter leg 34.

It may now be fully appreciated that the above disclosure provides significant advancements to the art of designing, constructing and using wear components for material handling implements. In examples described above, a wear cap 32 can be secured to an adapter leg 34, 36 using a fastener 38 that also limits rearward movement of the wear cap relative to the adapter leg.

The above disclosure provides to the art a wear component assembly 30 for use with a material handling implement 10. In one example, the wear component assembly 30 can include an adapter 14 having rearwardly extending first and second bifurcated legs 34, 36 configured to mount the adapter 14 to a lip 16 of the material handling implement 10, and a wear cap 32 secured external to the first leg 34 with a fastener 38. The fastener 38 extends laterally through the first leg 34.

The fastener 38 may be oriented orthogonal to a longitudinal axis 60 of the adapter 24. The wear cap 32 may comprise a rearward facing and laterally extending recess 48 configured to receive the fastener 38 therein. Contact between the fastener 38 and the recess 48 may limit rearward movement of the wear cap 32 relative to the adapter 14.

The fastener 38 may be tapered along a majority of a length of the fastener 38. The fastener 38 may be externally threaded. An internally threaded nut 46 may be secured to the fastener 38. A seal 68 may seal between the fastener 38 and the nut 46.

An opening 58 may extends through the wear cap 32. The wear cap opening 58 may be aligned with an opening 52 that extends through the first leg 34.

The wear cap 32 may comprise a forward facing recess 54 formed in a forward end of the wear cap 32. A portion of the adapter 14 may be received in the recess 54.

The above disclosure also provides to the art a wear component assembly 30 for use with a material handling implement 10, with the wear component assembly 30 comprising: an adapter 14 having rearwardly extending first and second bifurcated legs 34, 36 configured to mount the adapter 14 to a lip 16 of the material handling implement 10; and a wear cap 32 secured external to the first leg 34 with a fastener 38. Contact between the fastener 38 and a recess 48 formed in the wear cap 32 limits rearward movement of the wear cap 32 relative to the adapter 14.

The above disclosure also provides to the art a wear cap 32 for use with an adapter 14 on a material handling implement 10. In one example, the wear cap 32 includes a body 44 configured to overlie at least a portion of a leg 34, 36 of the adapter 14, a first tab 50 at a rear end of the body 44, the first tab 50 having a first recess 48 formed therein, the first recess 48 extending laterally across the first tab 50 and facing rearward, and a second tab 56 at a forward end of the body 44, the second tab 56 having a second recess 54 formed therein, the second recess 54 being configured to receive a portion of the adapter 14 therein.

The first recess 48 may be configured to receive a fastener 38 therein. The fastener 38 may be tapered along a majority of a length of the fastener 38.

An opening 58 may extend through the body 44. The body opening 58 may be being configured to align with an opening 52 that extends through the adapter leg 34.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A wear component assembly for use with a material handling implement, the wear component assembly comprising:

an adapter having rearwardly extending first and second bifurcated legs configured to mount the adapter to a lip of the material handling implement; and a wear cap secured external to the first leg with a fastener, in which the wear cap comprises a rearward facing and laterally extending recess configured to receive the fastener therein, and in which the fastener extends laterally through both the recess and the first leg.

2. The wear component assembly of claim 1, in which the fastener is oriented orthogonal to a longitudinal axis of the adapter.

3. The wear component assembly of claim 1, in which contact between the fastener and the recess limits rearward movement of the wear cap relative to the adapter.

4. The wear component assembly of claim 1, in which the fastener is tapered along a majority of a length of the fastener.

5. The wear component assembly of claim 1, in which the fastener is externally threaded, and further comprising an internally threaded nut secured to the fastener, and a seal that seals between the fastener and the nut.

6. The wear component assembly of claim 1, in which an opening extends through the wear cap, the wear cap opening being aligned with an opening that extends through the first leg.

7. The wear component assembly of claim 1, in which the wear cap comprises a forward facing recess formed in a forward end of the wear cap, and wherein a portion of the adapter is received in the recess.

8. A wear component assembly for use with a material handling implement, the wear component assembly comprising:

an adapter having rearwardly extending first and second bifurcated legs configured to mount the adapter to a lip of the material handling implement; and a wear cap secured external to the first leg with a fastener, in which contact between the fastener and a first recess formed in the wear cap limits rearward movement of the wear cap relative to the adapter.

9. The wear component assembly of claim 8, in which the fastener extends laterally through the first leg.

10. The wear component assembly of claim 8, in which the fastener is oriented orthogonal to a longitudinal axis of the adapter.

11. The wear component assembly of claim 8, in which the first recess faces rearward and extends laterally in the wear cap, and in which the first recess is configured to receive the fastener therein.

12. The wear component assembly of claim 8, in which the fastener is tapered along a majority of a length of the fastener.

13. The wear component assembly of claim 8,
in which the fastener is externally threaded, and
further comprising an internally threaded nut secured to the fastener, and a seal that seals between the fastener and the nut.

14. The wear component assembly of claim 8, in which an opening extends through the wear cap, the wear cap opening being aligned with an opening that extends through the first leg.

15. The wear component assembly of claim 8, in which the wear cap comprises a forward facing second recess formed in a forward end of the wear cap, and wherein a portion of the adapter is received in the second recess.

16. A wear cap for use with an adapter on a material handling implement, the wear cap comprising:

a body configured to overlie at least a portion of a leg of the adapter;

a first tab at a rear end of the body, the first tab having a first recess formed therein, the first recess extending laterally across the first tab and facing rearward, in which the first recess is configured to receive a fastener therein; and a second tab at a forward end of the body, the second tab having a second recess formed therein, the second recess being configured to receive a portion of the adapter therein.

17. The wear cap of claim 16, in which the fastener is tapered along a majority of a length of the fastener.

18. The wear cap of claim 16, in which an opening extends through the body, the body opening being configured to align with an opening that extends through the adapter leg.

* * * * *